US007973462B2

(12) United States Patent
Bizzozzero

(10) Patent No.: US 7,973,462 B2
(45) Date of Patent: Jul. 5, 2011

(54) UV LAMP WITH SINGLE PLUG

(75) Inventor: Luca Bizzozzero, Laveno Mombello (IT)

(73) Assignee: UV4 Tan S.R.L., Milan (IT)

( * ) Notice: Subject to any disclaimer, the term of this patent is extended or adjusted under 35 U.S.C. 154(b) by 81 days.

(21) Appl. No.: 12/500,228

(22) Filed: Jul. 9, 2009

(65) Prior Publication Data

US 2011/0006660 A1 Jan. 13, 2011

(51) Int. Cl.
*H01J 5/48* (2006.01)

(52) U.S. Cl. ..... 313/318.05; 313/623; 313/625; 607/91; 607/94

(58) Field of Classification Search ..... 313/318.05, 313/623–625; 607/91–94
See application file for complete search history.

(56) References Cited

U.S. PATENT DOCUMENTS 3,903,447 A * 9/1975 Young et al. ..... 313/493
4,934,768 A * 6/1990 Blaisdell ..... 313/1
5,285,128 A * 2/1994 Horvath et al. ..... 313/318.02
5,557,112 A * 9/1996 Csoknyai et al. ..... 250/504 R
5,565,685 A * 10/1996 Czako et al. ..... 250/504 R
5,600,199 A * 2/1997 Martin et al. ..... 313/318.02
5,712,485 A * 1/1998 Broer et al. ..... 250/474.1
6,316,877 B1 * 11/2001 Kaas ..... 315/56
6,340,861 B1 * 1/2002 Jakab et al. ..... 313/318.07
6,348,763 B1 * 2/2002 Collins ..... 313/634
6,402,964 B1 * 6/2002 Schmid ..... 210/198.1
6,494,901 B1 * 12/2002 Doty ..... 607/91
6,660,025 B2 * 12/2003 Versemann et al. ..... 607/94
2003/0060861 A1 * 3/2003 Versemann et al. ..... 607/91
2005/0226762 A1 * 10/2005 Naarup ..... 422/4
2008/0138241 A1 * 6/2008 Naarup ..... 422/4

* cited by examiner

*Primary Examiner* — Nimeshkumar D Patel
*Assistant Examiner* — Mary Ellen Bowman
(74) *Attorney, Agent, or Firm* — Pearne & Gordon LLP

(57) ABSTRACT

A UV lamp comprises: a bulb (2) containing a mixture of an inert gas and metallic halides; at least one first electrode (4) and one second (4) electrode associated with the bulb (2); a connector (6), coupled to the bulb (2) and having two thin metal plates (12*a*) protruding from a portion of said connector (6). Each flat thin plate (12*a*) is electrically connected to an electrode (4) and is spaced apart from the other thin plate (12*a*) by at least 20 mm.

9 Claims, 8 Drawing Sheets

FIG 3
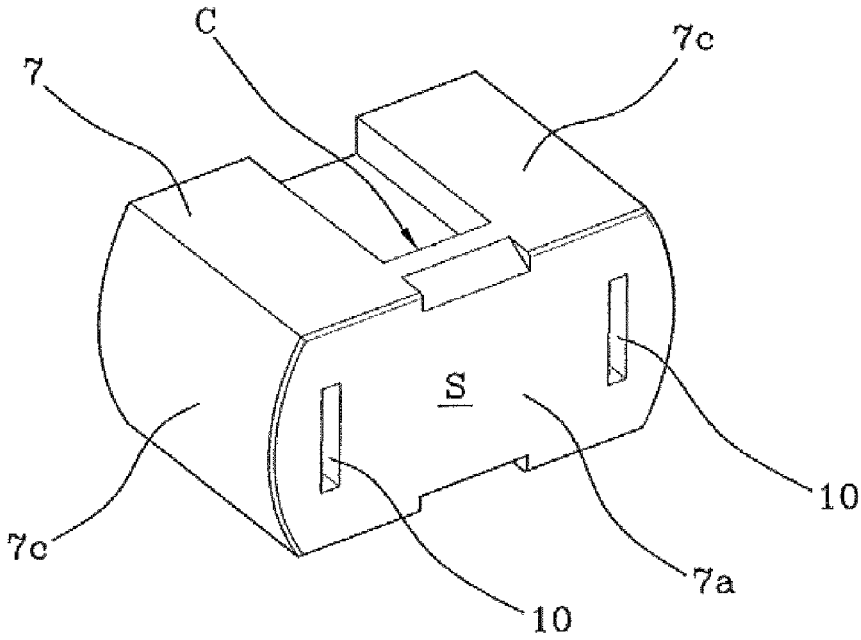
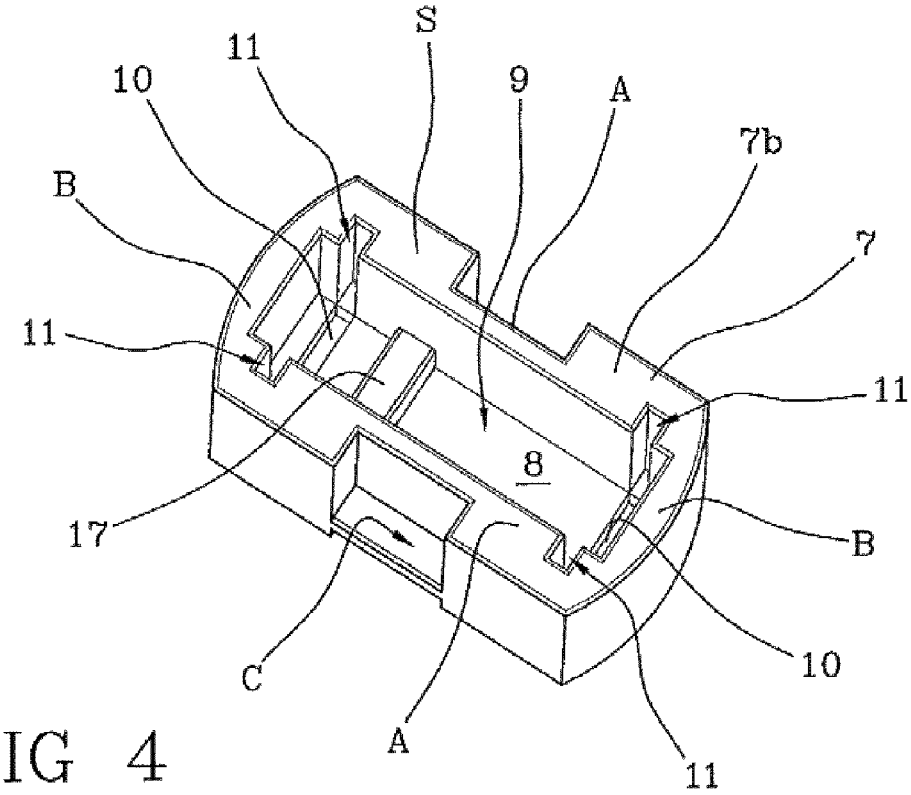
FIG 4

FIG 3a
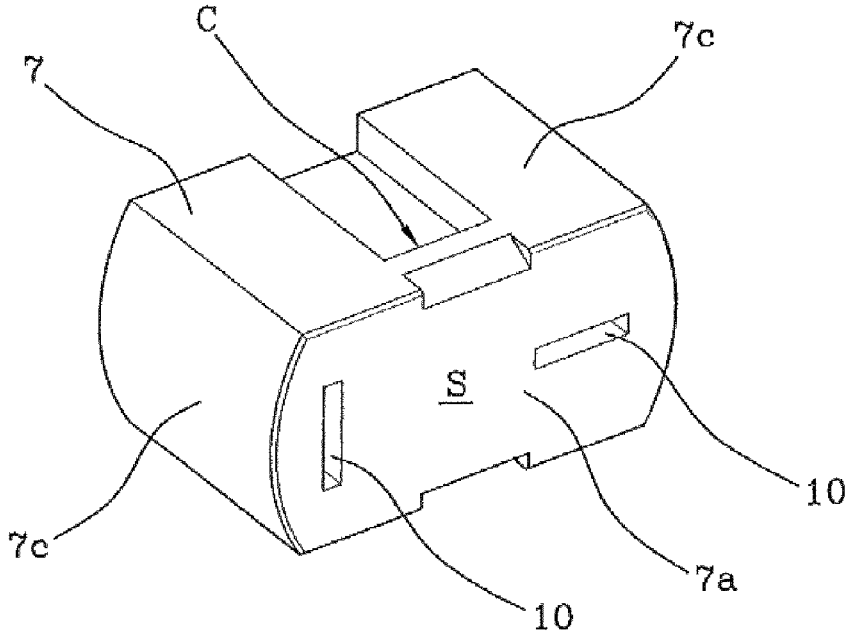
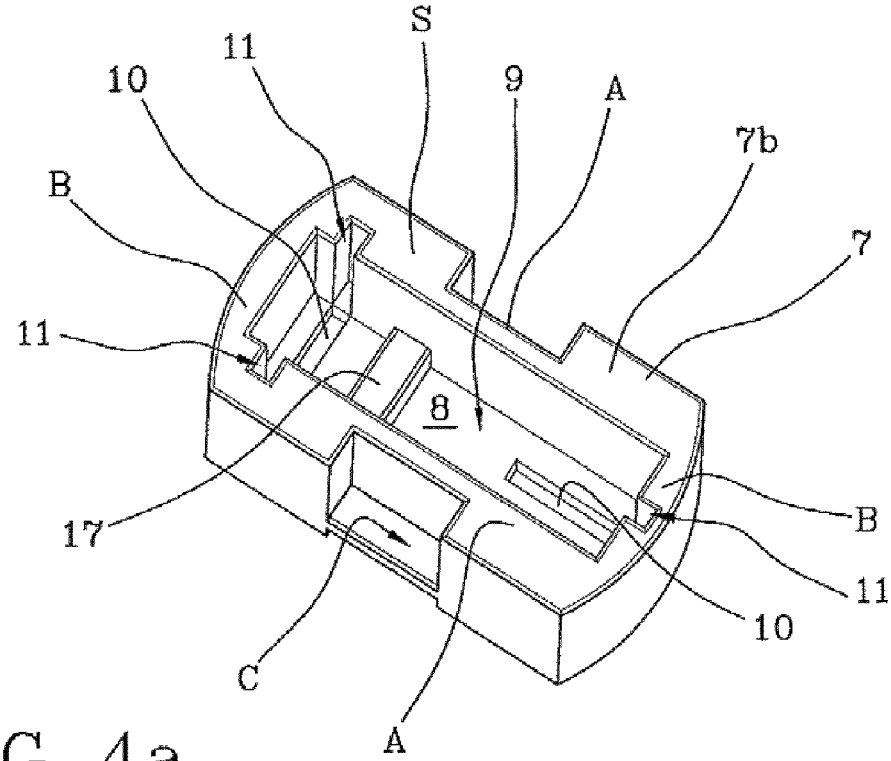
FIG 4a

UV LAMP WITH SINGLE PLUG

The present invention relates to a UV lamp or bulb with single plug.

FIELD OF THE INVENTION

In particular, the lamp in accordance with the invention is of the type based on metallic halides and applies to the sector of UV tanning lamps.

BACKGROUND OF THE INVENTION

Known in the UV tanning field is use of lamps enclosing an inert gas in a transparent bulb and having two electrodes at the bulb ends to submit the gas to an electric potential difference. By connecting the lamp to the domestic supply mains, the gas contained in the bulb and submitted to the potential difference imposed by the electrodes is activated and emits luminous and thermal power. This electric connection is obtained by providing an attachment terminal at one bulb end, which terminal has two projecting metal plugs of the standard type, of cylindrical shape, each of them being electrically connected to a respective electrode of the lamp. The two plugs can be coupled to a respective outlet of a tanning reflector by a known outlet-plug coupling.

The gas enclosed in the bulb generally comprises an inert gas and metallic halides giving the gas specific brilliancy and conductivity properties when said gas is passed through by electric current.

A very high electric potential difference (in the order of some thousands of volts) is required by these lamps, on switching on, which difference is necessary to overcome the insulating characteristics of the inert gas enclosed in the bulb and to create a current passage through the gas. While this potential difference is applied for a short period of time as required for generating an electric discharge through the gas, it causes electric overloads and in particular overcurrents tending to damage the plugs both in terms of melting of the plugs themselves due to said overcurrents, and in terms of electric discharges between the two plugs following the initial overvoltage imparted thereto.

It will recognised in fact that when the two plugs form an attachment of the known outlet-plug type, they are mutually spaced apart by an amount that is often insufficient to avoid occurrence of electric discharges between the plugs themselves on switching on of the lamp. This fact is also linked to the continuous technological evolution of the lamps that are planned in such a manner that they can operate at increasingly heavier operating parameters, such as power, voltage, current and temperature, while the geometry of the attachment and plugs has remained substantially unchanged over time.

SUMMARY OF THE INVENTION

As a consequence of the above, the UV lamps of known type are frequently subjected to irregularities in the lamp operation, as well as to the risk of permanent damages to the lamp itself which will result in the necessity to replace it.

Accordingly, the technical task of the present invention is to make available a UV lamp that is free from the above complained drawbacks.

Within the scope of this technical task, it is an important aim of the invention to propose a UV lamp having a high regularity in operation.

It is a further aim of the invention to make available a UV lamp having a long operating lifetime.

The foregoing and further aims that will become more apparent in the following of the present specification are substantially achieved by a UV lamp having the features set out in claim 1 and/or in one or more of the claims depending thereon.

According to a further aspect of the invention, a fitting base for UV lamps is proposed which has the features set out in claim 16.

BRIEF DESCRIPTION OF THE DRAWINGS

A non exclusive embodiment of a UV lamp in accordance with the present invention is now described by way of non-limiting example, with the aid of the accompanying drawings, in which:

FIGS. 3 and 3*a* are a first perspective view of a second portion of the lamp seen in FIGS. 1 and 1*a* respectively;

FIGS. 4 and 4*a* are a second perspective view of the lamp portion seen in FIGS. 3 and 3*a* respectively;

DETAILED DESCRIPTION OF EXAMPLE EMBODIMENTS OF THE INVENTION

With reference to the drawings, a UV lamp or bulb with single plug in accordance with the invention has been generally identified with 1.

Lamp 1 can be advantageously used in tanning systems and, more particularly, in semicylindrical reflectors adapted to be turned towards a user to impinge on the user himself/herself with tanning UV rays.

Figure 1:
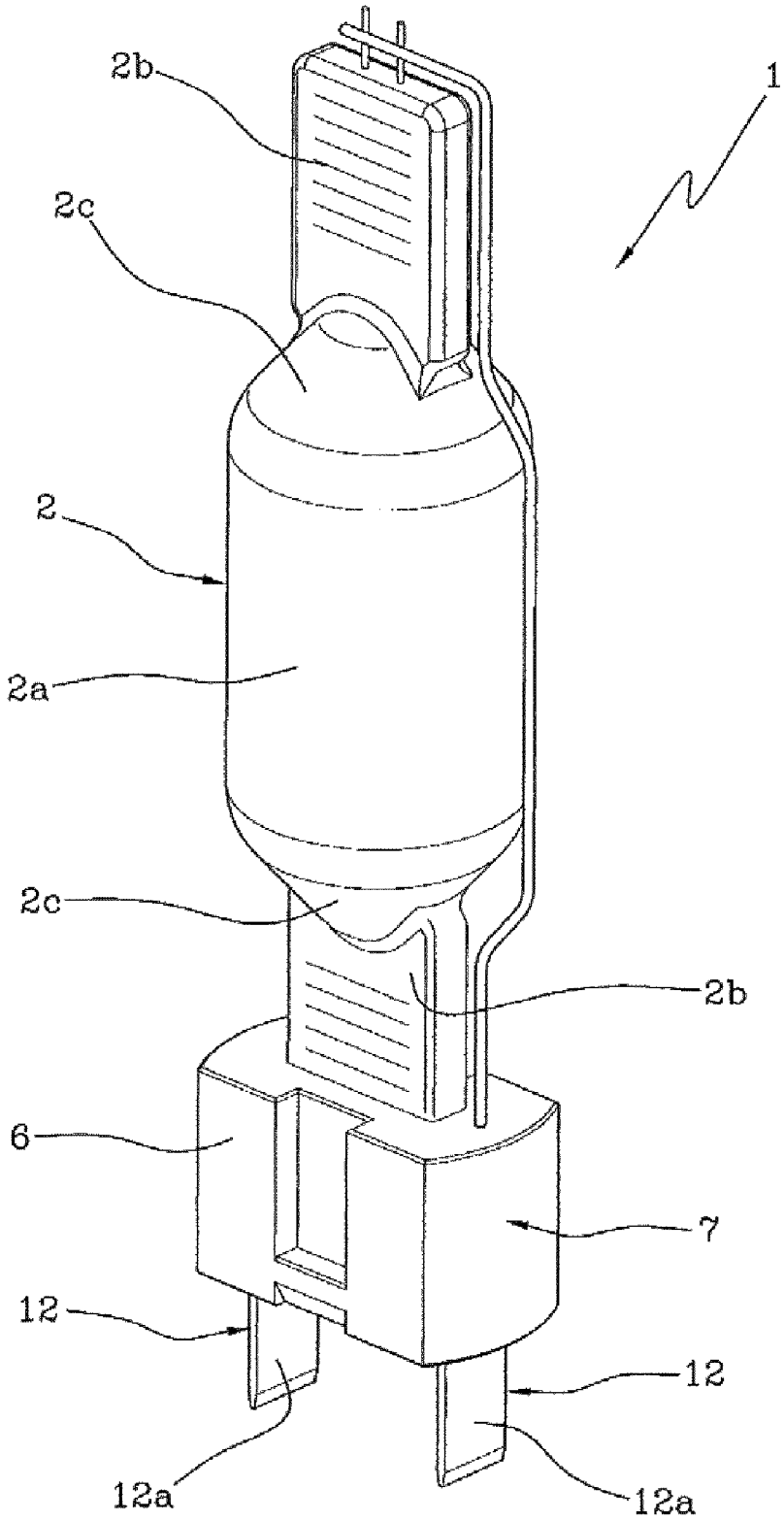
FIGS. 1 and 1*a* are a perspective view of two embodiments of a lamp in accordance with the present invention.
Figure 2:
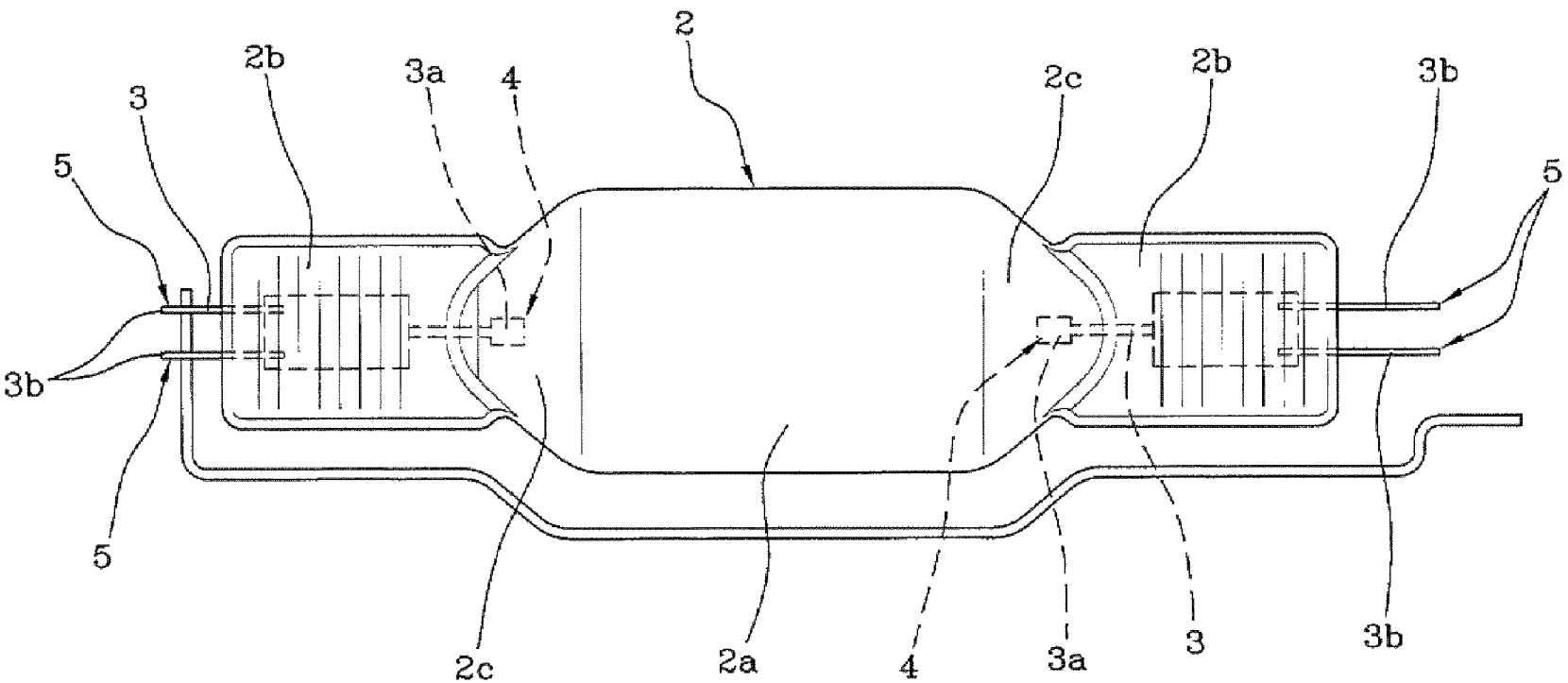
FIG. 2 is a perspective view of a first portion of the lamp seen in FIG. 1.

In accordance with the drawing shown in FIG. 1, lamp 1 comprises a hollow bulb 2, at least transparent to the UV rays. Bulb 2 has a central portion 2*a* which is substantially cylindrical with a circular section, and two opposite end portions 2*b* connected to the central portion by frustoconical portions 2*c*, as viewed from FIG. 2.

Buried into each of the two end portions 2*b* is a respective metal conductor 3 which has a first end 3*a* opening internally of bulb 2 and defining an electrode 4 of the bulb 2 itself, and a second end 3*b* emerging from bulb 2 and defining a feed clamp for the bulb 2 itself. The two electrodes 4 are disposed at opposite positions relative to each other and mutually facing, so that the two electrodes face the central portion 2*a* of bulb 2.

Bulb 2, and in particular the central portion 2*a*, holds an aeriform mixture comprising an inert gas and metallic halides. This mixture submitted to an electric discharge between the two electrodes 4, in known manner, emits thermal and luminous power also to frequencies higher than the visible frequencies' range and therefore also UV frequencies useful in the tanning field.

Lamp 1 according to the invention further comprises a single connector 6, which is steadily coupled to one of the two end portions 2*b* of bulb 2. Connector 6 comprises a main body 7 having a substantially box-shaped conformation and provided with a front portion 7*a* that is able to be coupled to a corresponding fitting base 100 of a reflector not shown, a rear portion 7*b* opposite to the front portion 7*a* and a side surface 7*c* for connection between the front 7*a* and rear 7*b* portions. The front 7*a* and rear 7*b* portions define corresponding opposite surfaces "S" of substantially rectangular shape and for example flat. In particular, said surfaces "S" have a peripheral profile at least partly convex to facilitate grasping of the main body 7. In the embodiment shown in FIG. 3, surfaces "S" have straight major sides "A" and curved minor sides "B".

The main body 7 is made of an insulating material, for example a ceramic material.

The main body 7 has in particular a prismatic cavity 8 of rectangular section, having an access aperture 9 formed in the rear portion 7*b* of the main body 7. This cavity 8 for example extends from said access aperture 9 to the front portion 7*a* of the main body and, at said front portion 7*a*, is delimited by one of the two opposite surfaces "S". Surface "S" positioned at the front portion 7*a* of the main body 7 has two through openings 10, in particular shaped like slits. Openings 10 have an elongated rectangular conformation and are in a first embodiment (FIG. 1) disposed parallel to each other and in a second embodiment (FIG. 1*a*) orthogonal to each other to a minimum mutual distance of 20 mm (the distance is to be taken between the respective longitudinal central axes, i.e. from the respective middle point of the tips), for reasons to be clarified in the following.

As shown in the embodiment depicted in FIG. 3, surface "S" positioned at the front portion 7*a* of the main body 7 is substantially closed, except for the two openings 10, and defines a surface delimiting cavity 8.

The main body 7 further has two pairs of parallel grooves 11 (first embodiment, FIGS. 3 and 4), facing cavity 8 and each of which is substantially aligned with one of said openings 10. The grooves 11 of each pair face each other and develop along a direction extending between the rear portion 7*a* of the main body 7 and the front portion 7 of same, in particular at right angles to said opposite surfaces "S".

In the embodiment depicted in FIG. 4, openings 10 are such disposed that their major extension direction is oriented perpendicular to the major sides "A" of surfaces "S".

In the embodiment depicted in FIG. 4*a*, openings 10 are such disposed that the first opening major extension direction is oriented perpendicular to the major sides "A" of surfaces "S", while the second opening major extension direction is oriented parallel to the major sides "A" of surfaces "S".

The main body 7 further comprises two electric-connection elements 12, steadily associated with the main body 7 and electrically connected with respective clamps 5. In the embodiment as depicted, each electric-connection element 12 is electrically connected to a respective clamp 5 and then to one of said electrodes 4.

Advantageously, each electric-connection element 12 is a flat thin plate 12*a*; 12*b* for example made of a metallic material. Said thin-plate conformation of the electric-connection elements 12 gives rise to an elongated conformation of the elements 12 themselves and at the same time allows a corresponding transverse size of said elements 12 to be reduced as compared with the cylindrical plugs traditionally used. Therefore, as a result, a mutual distance between the electric-connection elements 12 can be increased without increasing the sizes of connector 6, and in addition a greater heat dissipation connected with the elongated and particularly thin conformation of the thin plates 12*a* is obtained.

Figure 6:
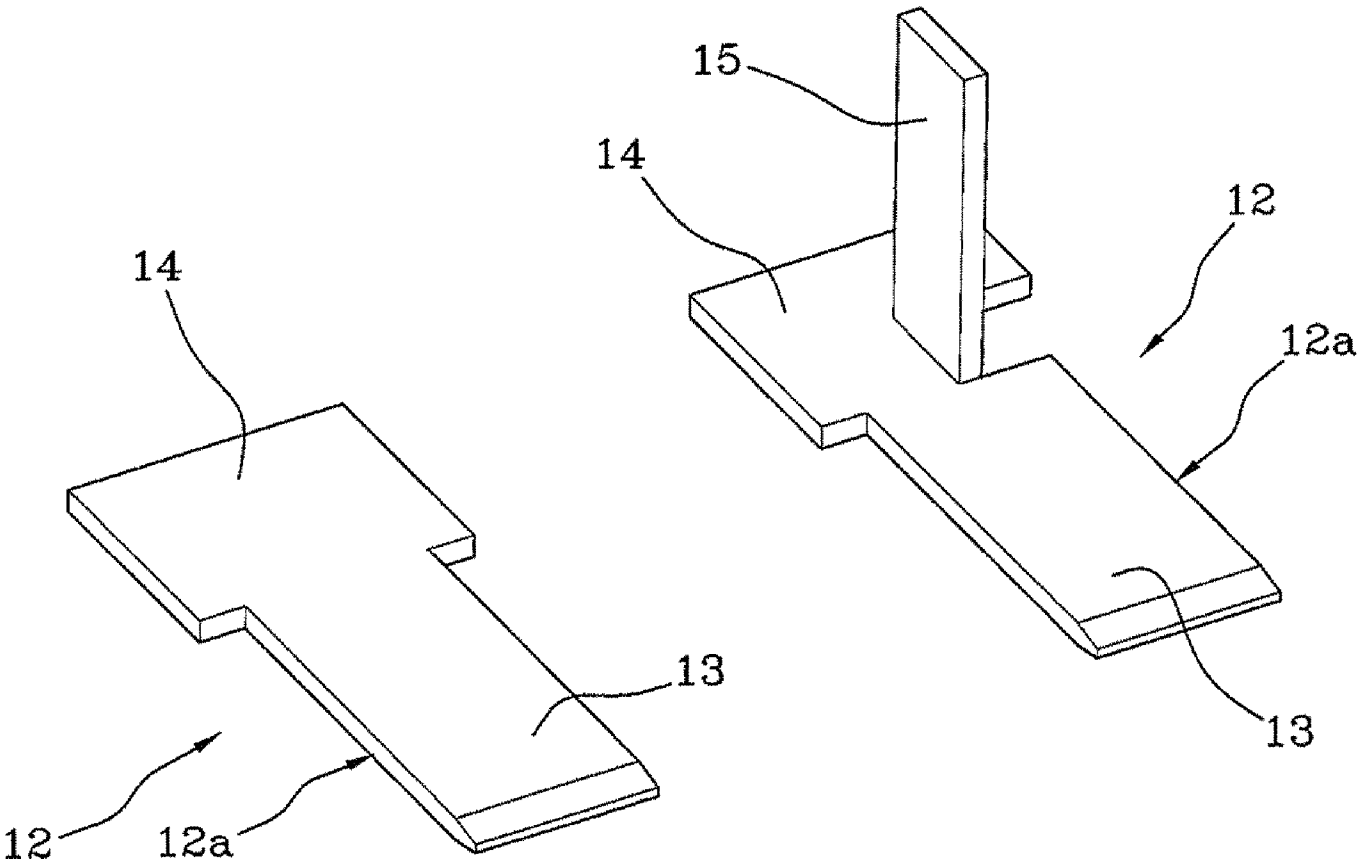
FIG. 6 shows a perspective view of a pair of components of the lamp seen in FIG. 1.

As shown in FIG. 6, each thin plate 12*a* has a first portion 13 the size of which is smaller than a corresponding size of one of said openings 10, and a second portion 14 opposite to the first one 13, which is of greater size than said opening 10. The thin plates 12*a*; 12*b* have a constant thickness smaller than 3 mm, in particular of about 1 mm.

Each thin plate 12*a* is inserted astride a respective opening 10, so that the first portion 13 of smaller size is partly inserted into opening 10 and partly protrudes externally of the main body 7 and away from the front portion 7*a* of the latter. The second portion 14 of the thin plate 12*a* on the contrary protrudes internally of cavity 8 and is advantageously in engagement in one of said pairs of grooves 11. Said variation in sizes between the first 13 and second 14 portions of the thin plates 12*a* defines an abutment of each thin plate 12*a* on a surface of the front portion 7*a* facing cavity 8, thus preventing the thin plate 12*a* to slip off the respective opening 10.

Thin plates 12*a* are parallel (FIG. 1) or orthogonal (FIG. 1*a*) to each other and, in accordance with the description concerning openings 10, the thin plates 12*a* are spaced apart from each other by at least 20 mm, in particular 22 mm. As shown in FIG. 1, the thin plates 12*a* are mutually disposed in such a manner that their major extension surfaces face each other.

Figure 1A:
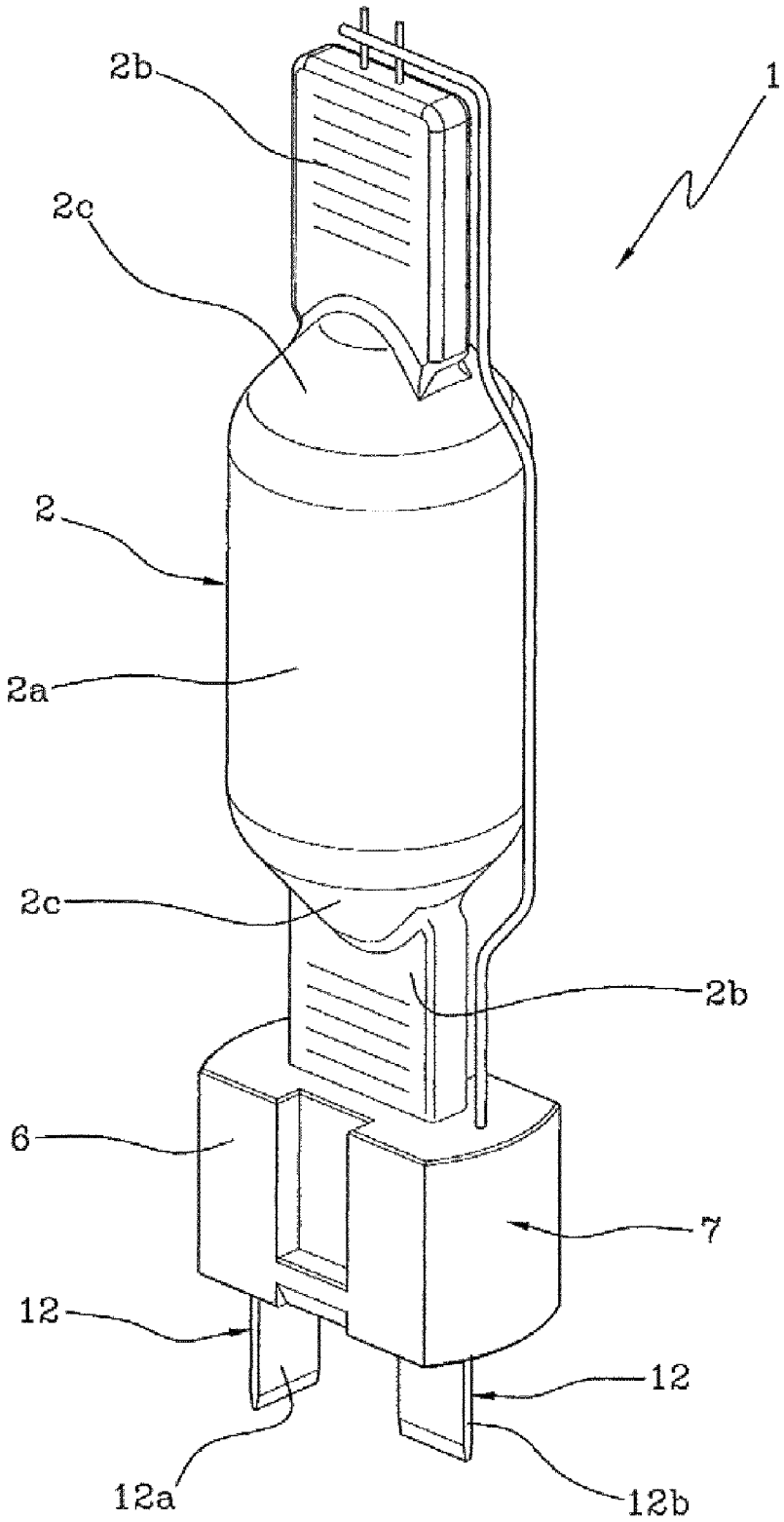

As shown in FIG. 1*a*, the thin plates 12*a* are mutually disposed in such a manner that the major extension surface of the first plate 12*a* faces the lateral short side of the second plate 12*b*.

In the just described configuration, the first portion 13 of the thin plates 12*a* protruding externally of the main body 7 can be engaged within said fitting base 100 of a UV reflector while the second portion 14 of each thin plate 12*a* is electrically connected to an electrode 4 of lamp 1.

Advantageously, the first portion 13 of each flat thin plate 12*a* has a maximum cross section of 10 $mm^2$, for example of 8 $mm^2$, which is greater than the cross section of the cylindrical plugs currently used in traditional UV lamps. Resulting therefrom is a lower electric resistance of the electric-connection elements 12 and therefore adaptability of same to use at higher voltages and currents than the standard values.

Advantageously, one of the two thin plates 12*a* has a tailpiece 15 extending inside cavity 8 and disposed transversely of a fitting direction of the thin plate 12*a* in the respective opening 10. In other words, tailpiece 15 is disposed substantially parallel to said front portion 7*a* of the main body 7, i.e. perpendicular to grooves 11. Provision of said tailpiece 15 occurs where clamp 4 electrically connected to said thin plate 12*a* is located at an offset position relative to the thin plate 12*a* itself, being therefore necessary to provide a metal element intercepting the electrode 4 and making a "bridge" between the clamp 4 and the thin plate 12*a* itself.

In the embodiment shown, tailpiece 15 faces the other thin plate 12*a*. Under this circumstance, in order to prevent initiation of electric discharges between the tailpiece 15 and the opposite thin plate 12*a*, the main body 7 has a partition wall 16 of insulating material, in particular of the same material as the main body 7 itself, interposed between the tailpiece 15 and the other thin plate 12*a*. Said partition wall 17 for example extends away from the front portion 7*a* of the main body 7 towards cavity 8.

At least partly inserted into cavity 8 and at the access aperture 9 is one of the end portions 2*b* of bulb 2. When insertion has occurred, each clamp 4 of bulb 2 is in electrical contact with one of the two thin plates 12*a* or, at least, with said tailpiece 15.

The cavity is further at least partly, in particular fully, filled with a malleable bonding material, of the hardening (setting) type, for example ceramic cement. This material, when hardening has occurred, causes locking to a steady position of the thin plates 12*a* and said end portion 2*b* of bulb 2 relative to the main body 7, therefore causing mutual fastening of connector 6 and bulb 2.

The thin plates 12*a* are therefore locked and they are prevented from being removed from the main body 7 due to the size variation of their two portions 13, 14, any undesirable insertion into cavity 8 being also inhibited due to the presence of the hardened bonding material. In fact the thin plates 12*a* are subjected to a thrust action towards cavity 8 following coupling between connector 7 and the fitting base 100, according to modalities to be described herebelow.

Figure 5A:
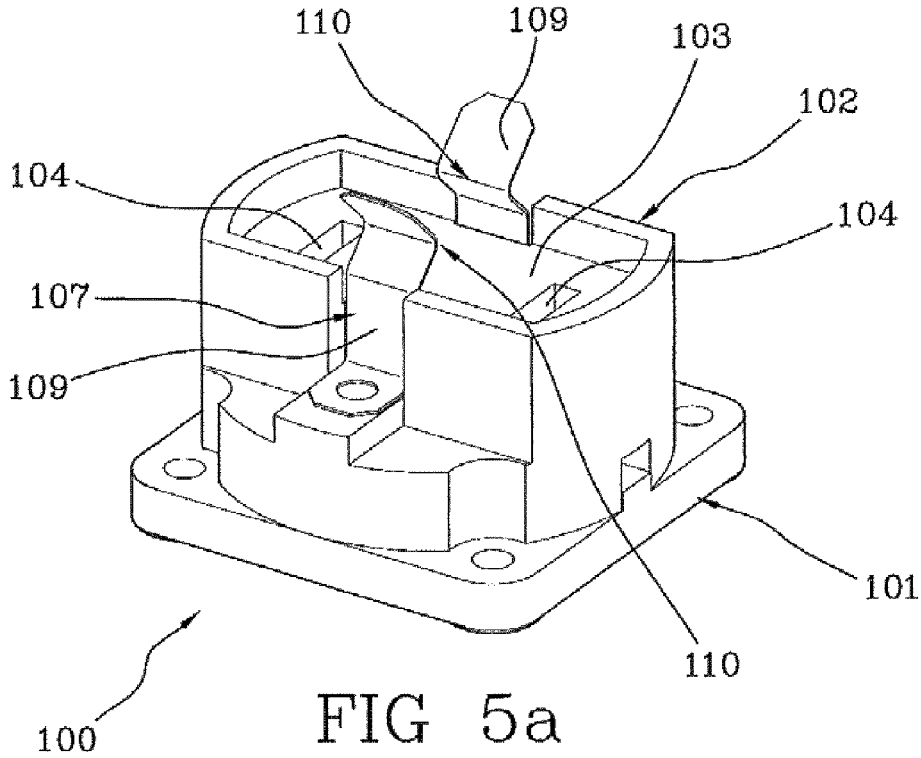
FIGS. 5*a* and 5*c* show a perspective view of a third portion of the lamp seen in FIGS. 1 and 1*a* respectively.

Shown in FIG. 5*a* is a fitting base 100 in accordance with the present invention. The fitting base comprises a support 101, to be steadily secured to a fixed portion of a UV reflector not shown, and a base element 102 steadily connected to the support. The base element is suitable for coupling with connector 6 of lamp 1 by an outlet-plug type coupling. In the embodiment shown, the base element 102 has an engagement surface 103 associable with the front portion 7*a* of the main body 7 of lamp 1. In detail, the engagement surface 103 is recessed relative to the outer overall sizes of the base element 102 to define a mutual support between the fitting base 100 and connector 6 also at a portion of the side surface 7*c* of the main body 7. In this regard, the shape of the engagement surface 103 substantially matches that of the front portion 7*a* of the main body 7. The engagement surface 103 is provided with a pair of fitting seats 104, each of which is adapted to house a corresponding first portion 13 of a thin plate 12*a* of lamp 1. The fitting seats 104 are spaced apart from each other by at least 20 mm, in particular 22 mm, and at most by 30 mm, and are positioned close to openings 10 of connector 6 when the latter is coupled to the fitting base 100.

Each fitting seat 104 is associated with a respective electric polarity, to power the two thin plates 12*a*, and therefore the two clamps 4 of lamp 1, with an electric potential difference.

Figure 5B:
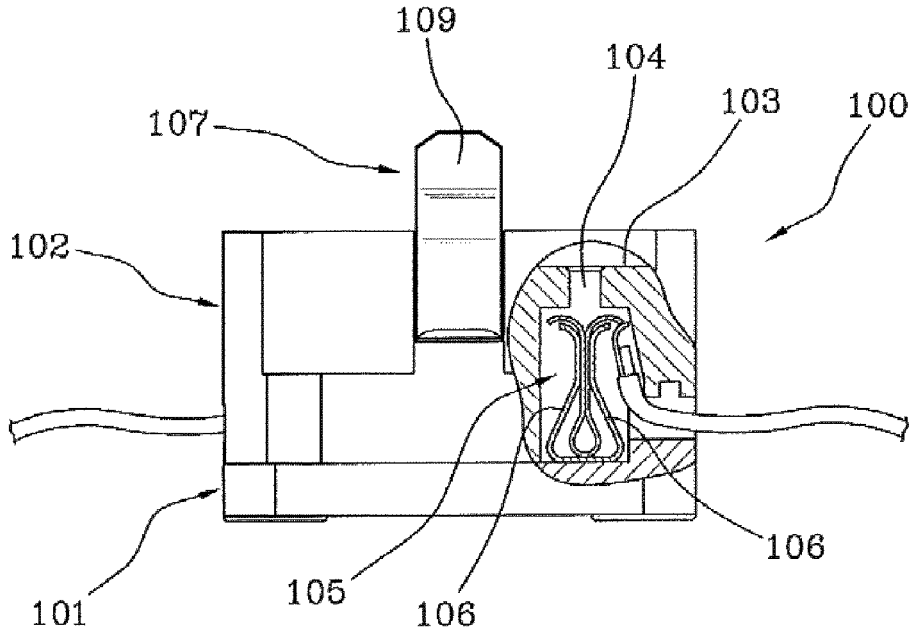
FIG. 5*b* shows a side view partly in section of the third portion in FIG. 5*a;*
Figure 5C:
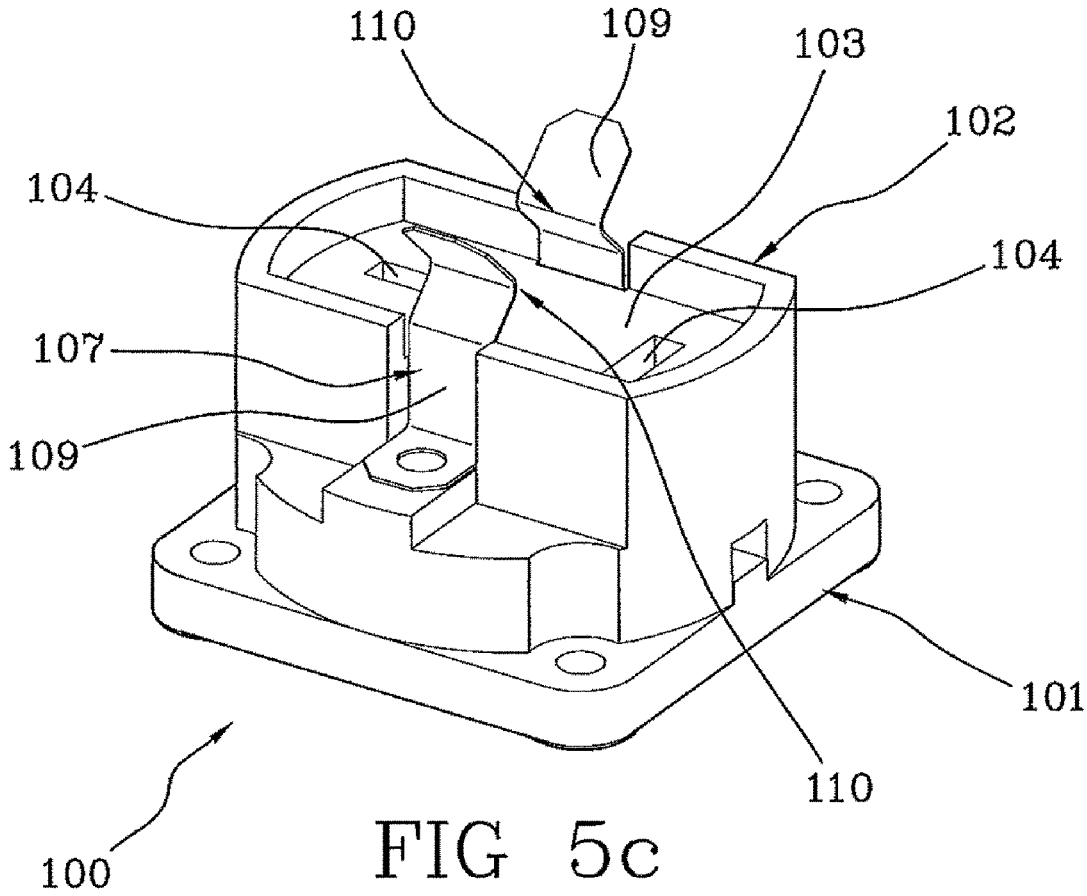

The embodiment of FIG. 5*c* differs from FIG. 5*a* since the fitting seats are orthogonal for receiving the lamp of FIG. 1*a*.

Advantageously, each fitting seat 104 is internally equipped with grasping means 105 elastically acting on the first portion 13 of a thin plate 12*a* to retain it in an inserted position inside the fitting seat 104. In accordance with an embodiment, shown in FIG. 5*b*, the grasping means 105 comprises a pair of opposite elastic tabs 106, between which the first portion 13 of a thin plate 12*a* can be pressure-fitted.

The fitting base 100 and lamp 1 further comprise mechanical-coupling means 107 acting on the fitting base 100 and on lamp 1 to generate a steady coupling therebetween. In particular, this mechanical-coupling means comprises at least one seat "C" formed in the main body 7 and able to be snap-engaged by spring means present on the fitting base 100. In the embodiment shown in FIG. 5*a*, said spring means comprises a pair of flexible elements 109 which are positioned at opposite portions of the base element 102 and can be deformed between a release position, at which said means is moved away from each other under the action of an external shape and a grasping position at which they are moved close to each other under a spring-back action. The flexible elements 109 have respective projections 110 facing each other and able to be snap-engaged engaged, in the grasping position, into said seats "C" of the main body 7 of lamp 1.

According to an embodiment not shown, the mechanical-coupling means 107 is removed. In such a configuration, connector 6 and the fitting base 100 are steadily associated by the grasping action exerted by the elastic tabs 106 on the first portions 13 of the thin plates 12*a*.

A mode of implementing a UV lamp in accordance with the present invention will be described hereinafter.

First, two thin plates 12*a* and a main body 7 in accordance with the previously described technical features are provided. Subsequently, the thin plates 12*a* are inserted into the main body 7 in such a manner that their first portions 13 are located at a position protruding externally of the main body 7. In more detail, during this step the above mentioned pairs of grooves 11 guide the thin plates 12*a*, and in particular the second portions 14 of the latter, until the first portions 13 of the thin plates 12*a* pass through openings 10 and the second ones. During this step, the thin plates 12*a* are such oriented that the first portions 13 face a fitting direction at the inside of cavity 8 of the main body 7.

At the end of this step, an end portion 2*b* of bulb 2 is at least partly inserted into cavity 8, and clamps 4 of bulb 2 are electrically connected to the thin plates 12*a*. Alternatively, the step of electrically connecting clamps 4 to the thin plates 12*a* can take place before insertion of the thin plates 12*a* into the respective openings 10, by welding of clamps 4 to the respective thin plates 12*a*, for example.

After the mentioned steps and in order to lock the main body 7, bulb 2 and thin plates 12*a* to a steady position, a final step is provided which consists in filling cavity 8 with said bonding material of the hardening type, which material, when hardening has occurred, prevents every relative movement between said parts of lamp 1.

The present invention attains the intended purposes and overcomes the drawbacks of the known art.

The plate-like conformation of the electric-connection elements in fact allows a greater heat dissipation resulting from passage of current through the same, enabling a greater flow of power supply to the UV lamp.

In addition, the cross section of the thin plates, that is increased relative to the plugs of the known art, enables a greater current intensity at the lamp input, which is particularly advantageous when the lamp is being switched on, under which conditions the overcurrents reach peaks that are even ten times the current values under normal operating conditions.

Furthermore, the distance between the thin plates is increased as compared with the distance existing between the plugs of the known art, which will avoid dangerous discharges initiating between traditionally used plugs during the switching-on transients when the applied voltage reaches high voltages, in particular 5000-6000 volts.

From the just described advantages it is possible to clearly infer that a UV lamp in accordance with the present invention has a regular operation devoid of unexpected and undesirable electric arcs, which will also involve a longer lifetime of the lamp itself.

The invention claimed is:

1. A UV lamp, comprising:

a bulb (2);

at least one first electrode (4) and one second electrode (4) associated with the bulb (2);

a connector (6), coupled to the bulb (2) and having two electric-connection elements (12) protruding from a portion of said connector (6); each of said electric-connection elements (6) being electrically connected to one of said electrodes (4);

wherein said two electric-connection elements (12) are spaced apart from each other by at least 20 mm, wherein said connector (6) comprises a main body (7), rigidly connected to the lamp bulb (2) and able to be steadily engaged to a corresponding fixed fitting base (100) of a UV-radiation reflector to position the lamp (1) relative to said reflector, and wherein said main body (7) has mechanical-coupling means (107) co-operating with said fitting base (100) to enable steady coupling between the lamp (1) and the fitting base (100), wherein said main body (7) has a pair of through openings (10) at a front portion (7*a*) thereof designed to face said fitting base (100), each of said electric-connection elements (12) being engaged in a respective opening (10), wherein said main body (7) has a cavity (8) communicating with said openings (10) and having an access aperture (9) facing away from said front portion (7*a*) so as to steadily house a portion of said bulb (2) internally of the cavity (8), said cavity (8) enabling insertion of said electric-connection elements (12) into the respective openings (10) and locking of the latter at a position bridging said openings (10), and wherein one of said electric-connection elements (12) has a tailpiece (15) disposed transversely of a fitting direction of said electric-connection element (12) in the respective opening (10), so as to intercept a portion of a conductor (3) electrically connected to one of said electrodes (4) and be electrically coupled thereto.

2. A lamp as claimed in claim 1, wherein said electric-connection elements (12) are flat thin plates (12*a*; 12*b*) either parallel to each other, and more in detail facing each other at the respective major extension surfaces, or orthogonal to each other.

3. A lamp as claimed in claim 1, wherein each of said electric-connection elements (12) has a first portion (13) designed to be electrically coupled to a fitting base (100) of a UV reflector, said first portion (13) having a maximum transverse section of 10 $mm^2$.

4. A lamp as claimed in claim 1, wherein said mechanical-coupling means (107) comprises at least one seat (C) formed in said main body (7) and adapted to be snap-engaged by corresponding spring means present on said fitting base (100).

5. A lamp as claimed in claim 1, wherein said main body (7) has two pairs of parallel grooves (11) facing said cavity (8) and each of which is substantially aligned with one of said openings (10), each electric-connection element (12) being able to be engaged in one of said pairs of grooves (11) so as to be guided during insertion into the respective opening (10).

6. A lamp as claimed in claim 1, wherein each of said electric-connection elements (12) has a first portion (13) that is partly inserted in an opening (10) and protrudes from the connector (6), and a second portion internal to the cavity (8) which has an increased section as compared with a corresponding size of the opening (10), in order to define an abutment for said electric-connection element (12) following insertion of the latter into said opening (10).

7. A lamp as claimed in claim 1, wherein said tailpiece (15) extends inside said cavity (8) and faces the other electric-connection element (12), said main body (7) having a partition wall (16) of insulating material interposed between said tailpiece (15) and said other electric-connection element (12).

8. A lamp as claimed in claim 1, wherein said cavity (8) is at least partly filled with a bonding material of the hardening (setting) type, to steadily fasten at least the main body (7), electric-connection elements (12) and bulb (2) to each other.

9. A fitting base for UV lamps according to claim 1, comprising:

a base element (102) designed to be steadily coupled to a portion of a UV reflector and having a pair of fitting seats (104) for corresponding electric-connection elements (12) of a UV lamp (1);

mechanical-coupling means (107) positioned on the base element (102) and acting on at least one portion of said UV lamp (1) to retain said UV lamp (1) on the base element (102);

wherein said fitting seats (104) are spaced apart from each other by at least 20 mm.

* * * * *